US008079833B2

(12) United States Patent
Brecht et al.

(10) Patent No.: US 8,079,833 B2
(45) Date of Patent: Dec. 20, 2011

(54) ELECTRIC MOTOR HAVING A COAXIALLY ASSOCIATED PUMP

(75) Inventors: Bernhard Brecht, Weinstrasse (DE); Ralf Graber, Frankenthal (DE); Uwe Bruhns, Osthofen (DE); Harald Hartmann, Kindenheim (DE)

(73) Assignee: KSB Aktiengesellschaft, Frankenthal (DE)

( * ) Notice: Subject to any disclaimer, the term of this patent is extended or adjusted under 35 U.S.C. 154(b) by 13 days.

(21) Appl. No.: 11/492,985

(22) Filed: Jul. 26, 2006

(65) Prior Publication Data

US 2007/0025865 A1 Feb. 1, 2007

Related U.S. Application Data

(60) Provisional application No. 60/724,269, filed on Oct. 7, 2005.

(30) Foreign Application Priority Data

Jul. 29, 2005 (DE) ..... 10 2005 036 347

(51) Int. Cl.
*F04B 35/04* (2006.01)

(52) U.S. Cl. ..... 417/423.1

(58) Field of Classification Search ..... 417/423.8, 417/423.1, 423.12; 74/572, 572.11; 376/210; 165/47; 29/894
See application file for complete search history.

(56) References Cited

U.S. PATENT DOCUMENTS 2,115,895 A * 5/1938 Weihmann ..... 416/180
3,022,433 A 2/1962 Ferranti
3,450,056 A 6/1969 Heathcote et al.
3,519,861 A * 7/1970 Guthan ..... 310/87
3,716,732 A 2/1973 Tillma
3,918,830 A 11/1975 Schneider
3,947,153 A 3/1976 Matthias et al.
3,960,034 A 6/1976 Hintergraeber
4,084,924 A 4/1978 Ivanoff et al.
4,545,741 A * 10/1985 Tomioka et al. ..... 417/365

(Continued)

FOREIGN PATENT DOCUMENTS

AT 346 967 12/1978

(Continued)

OTHER PUBLICATIONS

German Search Report dated Jun. 26, 2006, including an English translation of relevant portion (Four (4) pages).

*Primary Examiner* — Charles Freay
*Assistant Examiner* — Amene Bayou
(74) *Attorney, Agent, or Firm* — Crowell & Moring LLP

(57) ABSTRACT

An electric motor (1) having a coaxially associated pump (6) for a coolant circuit, in particular in a system with temperature transfer and/or heat transfer, in which a shaft assembly (5) transmits a torque from the electric motor (1) to at least one impeller (8) arranged in the pump housing (7) within housing parts (7, 10) in the form of a hermetically sealed pressure enclosure, and a flywheel (12) is arranged between the electric motor (1) and the pump housing (7). All of the rotating parts are arranged within a hermetically sealed motor/pump unit, and the motor/pump unit is filled with fluid. The flywheel (12) comprises a flywheel body (13) made from a high-strength material having a large number of cavities (16, 17) with inserts (16, 17) formed of or containing a heavy metal having a density greater than 11.0 kg/dm$^3$arranged in the cavities.

20 Claims, 3 Drawing Sheets

U.S. PATENT DOCUMENTS 4,616,980 A * 10/1986 Carpenter ..... 417/357
4,674,356 A * 6/1987 Kilgore ..... 74/570.2
4,684,329 A * 8/1987 Hashimoto ..... 417/357
4,886,430 A 12/1989 Veronesi et al.
5,165,305 A * 11/1992 Veronesi ..... 74/572.21
5,336,064 A * 8/1994 Lamers ..... 417/423.3
5,356,273 A * 10/1994 Nixon ..... 417/423.12
5,549,459 A 8/1996 Nixon
5,590,569 A * 1/1997 Nardone et al. ..... 74/572.12
5,604,777 A * 2/1997 Raymond et al. ..... 376/310
5,729,903 A * 3/1998 Bitterly et al. ..... 29/894
5,979,375 A * 11/1999 Ballardini ..... 123/48 B
6,727,616 B1 * 4/2004 Gabrys et al. ..... 310/90.5
7,044,022 B2 * 5/2006 Kim ..... 74/574.2

FOREIGN PATENT DOCUMENTS

DE 23 28 265 A1 2/1975
DE 25 55 721 A1 6/1977
DE 28 07 876 A1 8/1978
DE 39 12 389 A1 10/1990
EP 0 351 488 A2 1/1990
FR 2 334 878 7/1977
GB 1 538 178 1/1979
JP 2003097646 A * 4/2003

* cited by examiner

ELECTRIC MOTOR HAVING A COAXIALLY ASSOCIATED PUMP

BACKGROUND OF THE INVENTION

The present invention relates to an electric motor having a coaxially associated pump for a coolant circuit, in particular in a system with temperature transfer and/or heat transfer, a shaft assembly transmitting a torque from the electric motor to at least one impeller arranged in the pump housing within housing parts in the form of a hermetically sealed pressure enclosure, and a flywheel being arranged between the electric motor and the pump housing, all of the rotating parts being arranged within a hermetically sealed motor/pump unit, and the motor/pump unit being filled with fluid.

It is known to use motor/pump units which are equipped with a flywheel in power stations which are equipped with heat generators and have temperature and/or heat transfer devices. This is a safety measure in order to be able to ensure that a coolant circulation through the pump is maintained for a minimum period of time as a result of the inertial capacity of a flywheel if a fault should occur. Due to the moment of inertia of the flywheel, an electric motor of this type continues to rotoate even in the event of a power failure, and in this case the motor/pump unit conveys an amount of coolant. Although the amount of coolant is reduced, it is sufficient to ensure heat dissipation in a heat transfer device until the heat generator has been reliably switched off.

U.S. Pat. No. 3,960,034 discloses a so-called dry electric motor, in which the motor and the flywheel are cooled with air. In addition, the flywheel in this device is equipped with a protective device in order to rule out any danger to the surroundings as a result of an exploding flywheel in the event of excessive speeds.

However, in motor/pump units without a shaft seal, as disclosed in U.S. Pat. Nos. 4,084 876 or 4,084,924 (=DE 2,807,876), a hydrodynamic frictional resistance is produced by a motor filled with a coolant and by a flywheel rotating in the coolant. Rotation of the flywheel in the coolant, which often is water, results in a high power loss due to the hydrodynamic friction and the production of thermal energy. This reduces the overall efficiency of the pump, the motor and the flywheel. This motor/pump unit has a thermal barrier between the pump part and the motor part which has a thin housing neck in order to keep the thermal conduction between the hot pump housing and the cooled motor housing as low as possible. At the front end of the motor housing and within a pressure-tight common housing, a flywheel, which is driven by the shaft assembly, is located behind the thermal barrier. In addition, the flywheel is surrounded by an outer cover, which is mounted such that it can rotate in the housing and has inlet openings for the fluid located in the motor housing, in order to reduce the hydrodynamic frictional losses. During operation, the outer cover assumes an average speed which is less than the speed of the flywheel owing to the hydrodynamic friction surfaces between the housing, the outer cover and the flywheel. This should result in a reduction in the frictional losses on the flywheel arranged in the cooler motor part.

An electric motor in the form of a split-cage motor for a motor/pump unit having a flywheel is disclosed in U.S. Pat. No. 4,886,430 (=EP 351,488). The flywheel in the form of a bearing element is formed within the housing parts forming a pressure enclosure, in the region of a pressure-side pump housing cover of the encapsulated motor/pump unit filled with fluid. The flywheel takes on the radial bearing function for the shaft assembly in the region of the pump housing. In addition, since the flywheel is also in the form of an axial bearing, in contrast to the solution according to U.S. Pat. No. 4,084,924, an axial bearing arrangement at the motor end remote from the pump has been omitted.

A pot-shaped insert is arranged in the housing as an integrated thermal barrier between the pump housing and the flywheel absorbing the bearing forces. This thermal barrier is provided with insulating air chambers on the outside and opposite the pump part. Additional external fluid cooling is arranged on its inside facing the flywheel front end. A wall element absorbing bearing forces is also arranged between the fluid cooling and the front end, near to the pump, of the flywheel. Due to the design as a split-cage motor/pump unit, the flywheel chamber and the rotor chamber of the electric motor are filled with the conveyed fluid to be pumped, and these chambers are subjected to the same pressure as the pump housing, while the stator chamber of the motor is designed to be dry. A heat exchanger surrounds the motor, and the water which lubricates and cools bearing elements bearing against the flywheel, flows through the heat exchanger. This cooling circuit for the motor, the radial and axial bearings and the flywheel also flows through the flywheel itself. Such an arrangement, however, weakens the spider/shaft connection of the flywheel.

SUMMARY OF THE INVENTION

It is therefore an object of the invention to provide an improved flywheel arrangement for motor/pump units equipped with a flywheel.

Another object of the invention is to provide a motor/pump unit equipped with a flywheel in which both the operational reliability is increased and the power loss due to hydrodynamic friction of the flywheel is decreased.

A further object of the invention is to provide an improved flywheel design.

These and other objects are achieved in accordance with the present invention by providing a motor/pump assembly comprising a fluid-filled, hermetically sealed pressure enclosure containing an electric motor, a coolant pump coaxial with the motor comprising at least one impeller arranged in a pump housing, a shaft assembly for transmitting a torque from the motor to the at least one impeller, and a flywheel on the shaft assembly between the electric motor and the pump, in which the flywheel comprises a flywheel body having a plurality of cavities with inserts comprising a heavy-metal having a density of greater than 11.0 kg/dm$^3$ arranged in the cavities.

Thus, in accordance with the invention, the flywheel comprises a flywheel body made of a high-strength material having a large number of cavities with heavy-metal inserts arranged in the cavities formed from a heavy metal having a density of greater than 11.0 kg/dm$^3$. This solution offers the advantage of it being possible to adapt to different operating situations more easily and more effectively. Due to the simplicity of selecting and arranging the cavities, various heavy-metal inserts can be inserted therein. For those application cases in which the conveyed fluid located in the motor/pump unit may undergo unfavourable reactions with the heavy-metal inserts, means are provided for screening the heavy-metal inserts from a surrounding fluid. These means may be arranged on the flywheel body and/or the inserts are provided with means for separating the heavy-metal inserts from a surrounding fluid.

Suitable heavy metals for use in or as the inserts include gold, uranium, tantalum and tungsten or alloys of those materials. If uranium is used, it is preferred to use an alloy of depleted uranium with up to about 2% molybdenum. Other possible heavy metals which could be used include lead and mercury, but these are less preferred for high temperature applications because of their lower melting points.

The flywheel is preferably made of a high strength steel, such as a chrome-nickel steel. Other materials of sufficient strength to withstand the thermal and mechanical stresses encountered by the flywheel with heavy metal inserts may be selected by persons skilled in the art.

It has proven to be particularly advantageous if the heavy-metal inserts are in the form of cartridges and are fixed in the flywheel body using known types of fasteners or the like. In such a case, the inserts can be produced reliably at another site, can thus be transported easily and are also suitable for storage. Subsequently, when a flywheel body has been completely prepared, they can be inserted into said flywheel body in a very simple manner. The heavy-metal inserts can be held in the flywheel body by known techniques such as welded joints, screw connections, soldering, adhesive bonding, shrink connections and compression connections, or the like. The type of connection is selected as a function of the respective operating conditions.

It is likewise possible for the heavy-metal inserts to be in the form of beds of bulk material filled into the cavities and for them to be held therein using known securing techniques. This would be a solution for cases in which the heavy metal is available as bulk-material granules or the like and is to be treated in a corresponding manner.

In accordance with another refinement of the invention, it has proven to be advantageous if the flywheel body does not have a hole for the purpose of passing through the shaft assembly. In the case of electric motors having very high drive powers, such as are used in large-scale power stations, very high forces act on such a flywheel. In this case, there is the risk that, starting from a through-hole for a shaft assembly, unfavourable stresses on the spider may result in the region of the transition between the flywheel body and the shaft assembly. In an extreme case, for example in the case of overload operation, these stresses on the spider may lead to breakage of the flywheel body.

It is more advantageous, on the other hand, to connect the flywheel body to the shaft assembly via one-piece or multi-part flange connections. This reduces the risk of breakage of the flywheel body considerably. End toothed sections, which serve the purpose of transmitting torque and form the connecting means between the flywheel body and the shaft assembly, are also advantageous.

Since the electric motor and the hermetically sealed motor/pump unit driven thereby are filled with conveyed fluid, there is the additional problem here of a flywheel rotating in the fluid also producing a high power loss owing to the fluid friction. However, it may be advantageous for economic or safety reasons to knowingly allow such a power loss in the region of the flywheel in order to thereby achieve the hermetic seal and to be able to dispense with the use of shaft seals which are susceptible to faults.

For this purpose, provision is made for at least one heat exchanger which surrounds the outer diameter of the flywheel to be arranged within the pressure enclosure and to form a radial wall face of a flywheel chamber, a high-pressure zone of the pump chamber to be connected to a side, remote from the pump, of the flywheel chamber by means of one or more flow paths guided over the outside of the heat exchanger, an annular gap between the heat exchanger and the flywheel to form a first return-flow path between the flywheel chamber remote from the pump and the flywheel chamber near to the pump, and a second return-flow path arranged in the region of the shaft assembly to connect the flywheel chamber near to the pump to the pump chamber.

This solution ensures a very high but operationally reliable temperature in the flywheel chamber. This is based on the knowledge that, at relatively high fluid temperatures within the flywheel chamber, the power losses produced in the process are severely reduced since the density of the fluid and its viscosity are reduced as a result of the influence of temperature and thus the frictional losses are minimized. Owing to the fact that the heat exchanger is arranged around the flywheel at a greater diameter, a particularly efficient cooling effect is achieved. An improved cooling effect occurs if a conveyed fluid drawn from the pump chamber flows away via the greatest diameter of the heat exchanger and enters the flywheel chamber on the side remote from the pump.

As a result of the pressure drop in the pump housing between a low pressure at the impeller inlet and a high pressure behind the impeller, behind a conducting device or in a spiral chamber, the conveyed fluid will flow back into the pump chamber via the flow and return-flow paths. Since the flywheel is not provided with holes, the cooled conveyed fluid will flow back, in the reverse direction, through the gap between the outer diameter of the flywheel and the inner diameter of the cylindrical heat exchanger. In this case, it is subjected additionally and a second time to the cooling effect of the heat exchanger and at the same time absorbs the heat losses produced by the friction of the flywheel. The conveyed fluid leaves the flywheel chamber at the smaller diameter in the region of the shaft assembly and at its other side near to the pump. Because relief holes are arranged in the impeller, the fluid flows back into the main flow of the pump. The pressure difference between the drawing opening and the inlet opening in the pump housing may be sufficient to drive this internal fluid flow.

The cooling effect can be improved by two or more heat exchangers coaxially surrounding the flywheel at larger diameters, and an annular gap or two or more channels forming the flow path to the flywheel chamber remote from the pump between these heat exchangers. The heat exchanger(s) is/are connected to an external cooling water source and may be, for example, cylindrical.

In addition, a further refinement of the invention provides for at least one conveying device, which is driven by the shaft assembly, to be arranged in the second return-flow path. This makes an increase in the throughput of the cooling fluid flow possible. This conveying device may be known means in the form of a small additional impeller, which is provided with holes or blades, a conveying thread or other known devices.

In accordance with other refinements, a pump-side motor cover forms the wall, remote from the pump, of the flywheel chamber, and a cooling device is arranged in the motor cover. This cooling device may be in the form of a low-pressure cooling device or in the form of a high-pressure cooling device. It is likewise possible for this cooling device to be constructed as part of a high-pressure motor cooling system. In order to reduce mixtures, a shaft seal is arranged between the motor chamber and the flywheel in the region of the shaft assembly. This shaft seal may be in the form of a throttling path, a labyrinth seal or the like.

BRIEF DESCRIPTION OF THE DRAWINGS

The invention will be described in further detail hereinafter with reference to illustrative preferred embodiments shown in the accompanying drawing figures, in which.

DETAILED DESCRIPTION OF PREFERRED EMBODIMENTS

Figure 1:
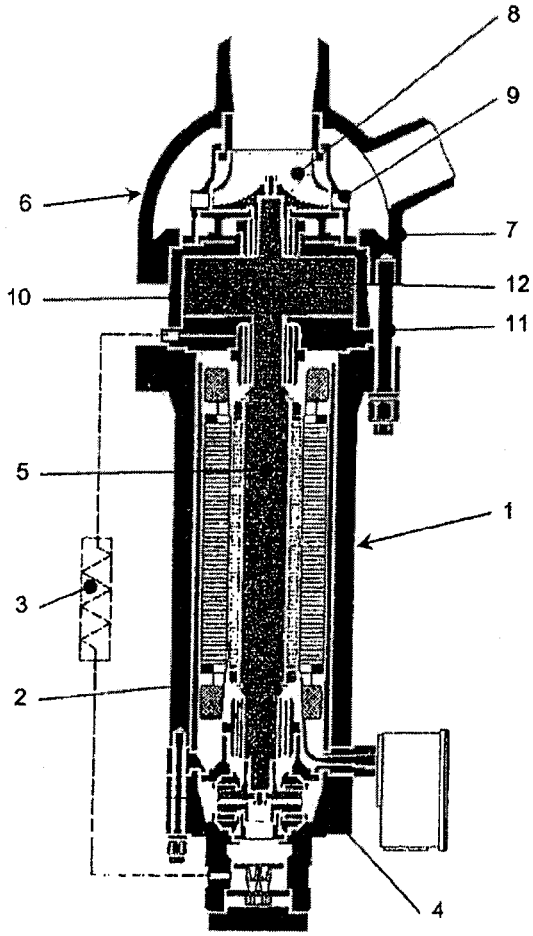
FIG. 1 is a cross sectional view through a motor/pump unit constructed in accordance with the invention.

FIG. 1 shows a fluid-cooled motor 1 having a housing 2 which is in the form of a pressure enclosure. The interior of the motor 1 is filled with fluid, and a high-pressure cooling system 3 is connected to the motor ends for the purpose of dissipating the electrical power loss. A radial bearing and an axial bearing are arranged at one motor end 4, the axial bearing at the same time acting as a conveying device for the cooling water circulating within the motor and through the cooler 3. The drive force of the motor acts on a shaft assembly 5 and thus transmits a torque to a pump 6 associated coaxially with the electric motor 1.

An impeller 8 with a downstream conducting device 9 is arranged within a pump housing 7, and the pump housing 7 is closed by a cover element 10 and connected to the housing 2 of the motor 1 by tie rods 11. A flywheel 12 is located within the cover element 10 which is in this case of multi-part design. The moment of inertia of the flywheel 12 ensures that the shaft assembly 5 with the connected impeller 8 continues to rotate in the event of a power failure and thus ensuring continued conveyance of coolant by the pump 6.

Those housing parts 2, 4, 7, 10 of the pump and the motor which delimit an interior with respect to a surrounding atmosphere form a so-called pressure enclosure. This pressure enclosure is designed for a very high system pressure which prevails in a system for heat transfer, in which system this motor/pump unit is installed for the purpose of circulating a conveyed fluid. Since such a unit is designed for drive powers of greater than 600 kilowatts and thus has an overproportional physical size, the illustration in FIG. 1 is merely schematic in nature. Details are shown in the enlarged illustration in the following FIGS. 2 and 3.

Figure 2:
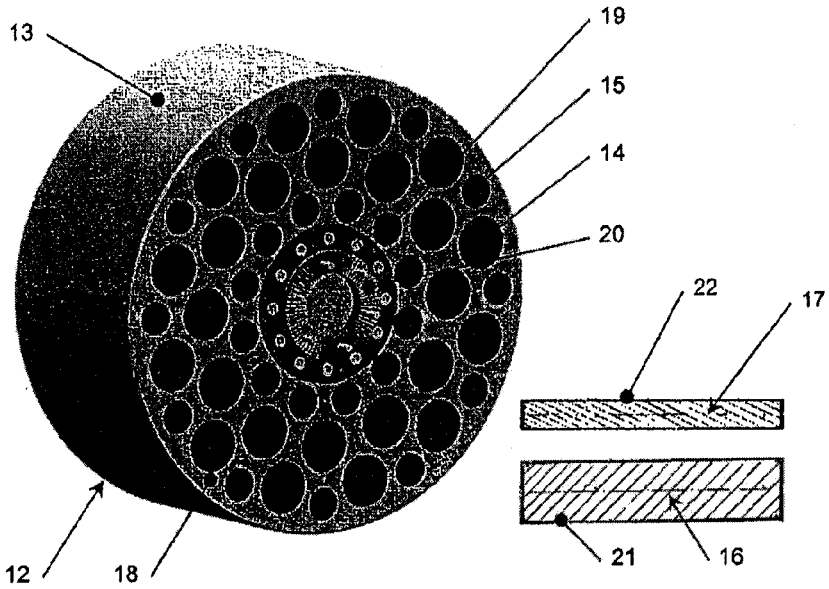
FIG. 2 is a perspective view of a flywheel body with heavy-metal inserts according to the invention.

FIG. 2 is a perspective view of a flywheel 12. The flywheel 12 comprises a flywheel body 13, which is illustrated using a light grey color in FIG. 2. The flywheel body 13 has a large number of cavities 14, 15, which are illustrated using a dark grey color. These cavities 14, 15 are used for accommodating heavy-metal inserts 16, 17, which serve to increase the moment of inertia of a ready-mounted flywheel 12. The cavities 14, 15 have different diameters, which ensures that the flywheel body 13, which is made from a high-strength material such as steel, is resistant to the centrifugal forces prevailing during operation. The arrangement, size and number of cavities 14, 15 ensures a reliable stress profile in the flywheel body 13 with high temperature influences. A sufficient reserve strength is thus ensured even in critical operating states, for example in the case of a turbine operation, caused by an operational fault, or overload operation of the pump, which results in a higher speed than the rated speed.

A flange connection 19 is fixed to the front end 18 of the cylindrical flywheel body 13 and is used to produce the connection to the shaft assembly 5. The end toothed section 20 shown here interacts with a corresponding formation of the shaft assembly 5 such that more reliable torque transmission is thus ensured. Other force-fitting and/or interlocking types of connection may also be used. In this case, however, it is necessary to ensure that these types of connection do not adversely affect the stress profile within the flywheel body 13.

It can also be seen in FIG. 2 that correspondingly dimensioned heavy-metal inserts 16, 17 are arranged in the cavities 14, 15 of various sizes. In this case, the heavy metal can be arranged as rod-shaped or bulk-material inserts. The heavy-metal inserts 16, 17 illustrated here show one variant in which the heavy metal is located within a cartridge 21, 22. Such a cartridge 21, 22 is simple to manufacture, easy to handle, to store and to transport and thus makes it possible to store such heavy-metal inserts 16, 17 without any problems. In addition, such a cartridge 21, 22 protects a heavy metal arranged therein against the influence of the cooling fluid which surrounds a flywheel 12, or vice versa.

The closure of such a cartridge, which is in this case cylindrical, takes place by means of known techniques and is possible using conventional machine tools. Special machines are not required for this purpose. Such a cartridge 21, 22 can be held within the flywheel body 13 using the known techniques. It is likewise easily possible for the cavities 14, 15 in the flywheel body 13 to be in the form of through-holes or blind holes and for a heavy metal to be arranged directly in them. In order to store a heavy metal located directly in the cavities 14, 15, the cavities can be closed by individual cover elements or by a large cover element corresponding to the diameter of the flywheel.

Figure 3:
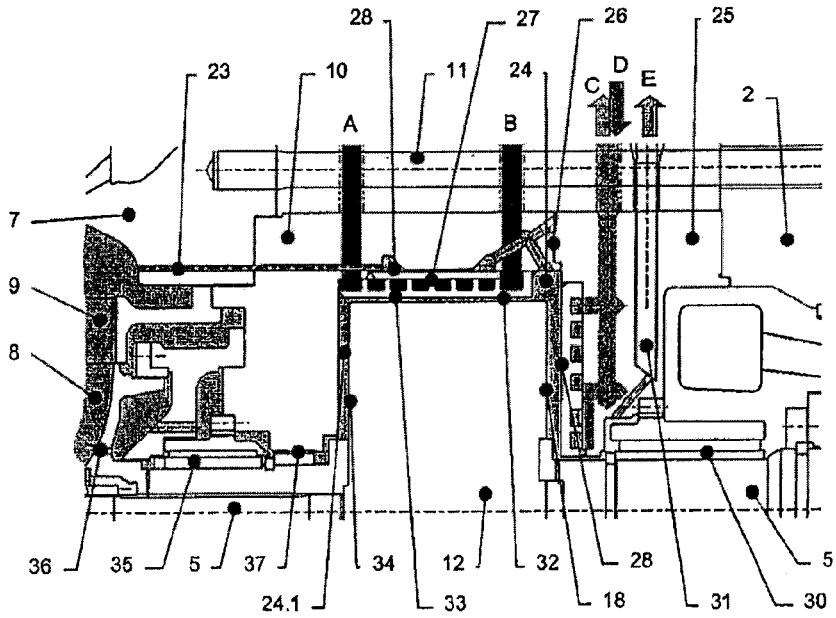
FIGS. 3 and 4 are enlarged views of the flywheel chamber.
Figure 4:
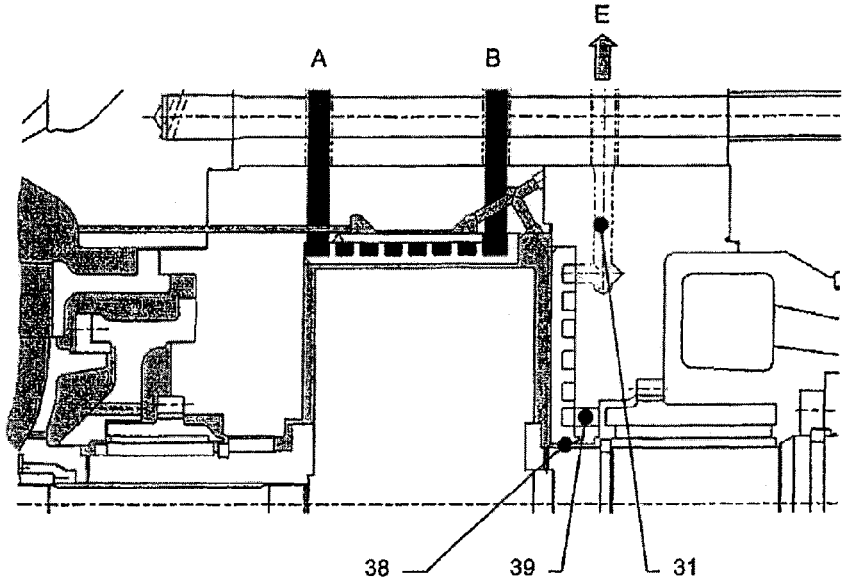

FIGS. 3 and 4 show enlarged illustrations of the arrangement of the flywheel in the shaft assembly and its position between the pump and the motor. The impeller 8 with a downstream conducting device 9 can be seen within the pump housing 6. Depending on the type of pump, there may a single-stage or multi-stage embodiment. In the single or last pump stage shown here, a discharge pipe can be seen in a zone at the highest pressure within the pump housing 7—in this case behind the conducting device 9. This discharge pipe acts as a flow path 23 for a conveyed fluid and directs this conveyed fluid within the pressure enclosure into the flywheel chamber 24.

A pump cover 10 and a motor cover 25 near to the pump form the flywheel chamber 24. The pressure-tight and fluid-tight bearing surface 26 of the two cover parts 10, 25 lies in the region of a front end 18, remote from the pump, of the flywheel 12. The two-part flywheel housing thus formed makes production and assembly easier. Tie rods 11, which are screwed into the pump housing 7 and abut a flange of the motor housing 2, are used to hold all of the parts together.

A heat exchanger 27, which surrounds the flywheel 12 and is connected to a low-pressure cooling system A-B passing through the pressure enclosure, is arranged within the flywheel chamber 24. The flow path 23 connecting the pump interior to the flywheel chamber 24 conducts a conveyed fluid over the outside 28 of the heat exchanger 27 to the side, remote from the pump, of the flywheel chamber 24. A further low-pressure cooling system C-D is arranged in the region of the motor cover 25 on the front end, remote from the pump, of the flywheel chamber 24, and a corresponding temperature drop in the region of the flywheel front end 18, remote from the pump, is achieved with the aid of this low-pressure cooling system C-D.

It can also be seen that the motor cover 25 has a connection for a high-pressure motor cooling system E, which is connected to the motor cooler 3. The arrows show the flow direction of the motor cooling fluid around the winding heads of the stator. At the same time they act as a lubricating fluid for the motor mount 30 near to the pump. The heated motor cooling fluid is removed via channels 31 in the motor cover 25 and is recooled via the motor cooler 3 illustrated in FIG. 1 and fed to the motor 1 again at the motor cover 4 remote from the pump.

A conveyed fluid entering the flywheel chamber 24 at its end remote from the pump flows through an annular gap 32 between the inside 33 of the heat exchanger 27 and the outer diameter of the flywheel 12 to the flywheel chamber 24.1 near to the pump. This annular gap 32 forms a first return-flow path for the conveyed fluid which, in this case, is at the same time subjected to the effect of the heat exchanger 27. It flows via the flywheel chamber 24.1 near to the pump to the front end 34, near to the pump, of the flywheel 12 in the direction of the shaft assembly 5. From the region of the shaft assembly 5, it then flows back to the impeller 8 of the pump 6 via the second return-flow path arranged there. In this case, a pump bearing 35 is lubricated at the same time. The flow direction depends on the pressure drop between the zone of high pressure in the pump housing 7 and the zone of lower pressure in the region of the impeller 8, which is defined by the axial thrust relief openings 36.

In the design of such a motor/pump unit, the size and number of flow paths is determined for the predetermined operating conditions in order to achieve a basic setting for the cooling conveyed fluid for the corresponding powers. It is likewise possible to provide an additional conveying device 37 in the region of the second flow path, this conveying device 37 being driven by the shaft assembly 5. In this illustrative embodiment, a conveying thread is illustrated, but it may equally well be a corresponding impeller or another known assisting conveying device 37. The cooling power of the conveyed fluid circulating in the flywheel chamber 24, 24.1 can thus be improved. The heat loss produced by the flywheel 12 by the hydrodynamic friction in the fluid is thus dissipated in a very effective manner by material transfer.

Due to the deliberate guidance of the internal cooling flow from the pump chamber to the flywheel chamber 24, 24.1, the temperature level in the flywheel chamber and also within the flywheel 12 can be influenced such that a homogeneous temperature level is achieved during operation. The attainment of the homogeneous temperature level in the flywheel 12 is assisted by the performance of the heat exchanger at the outer circumference of the flywheel 12 and the cooling effect at the flywheel front end 18 remote from the pump. Maintaining the homogeneity of the temperature level makes it possible to regulate this performance of the heat exchanger. The decisive advantage thus results that material stresses caused by temperature differences within the flywheel 12 are prevented.

For the operating state in which the temperature level is higher in the flywheel chamber than the temperature level of the conveyed fluid, with this solution heat can even be passed back to the circuit of the pump. It is thus possible for the lost heat to be partially regained. In this case, however, the temperature in the flywheel chamber 24, 24.1 is limited to a maximum which does not negatively influence the strength of the flywheel body.

FIG. 4 shows one variant of FIG. 3, in which only the low-pressure cooling system C-D in the region of the front end 8, remote from the pump, of the flywheel 12, has been dispensed with. Instead, the high-pressure motor cooling system E is at the same time used in this case for influencing the temperature level in the flywheel chamber 24 as well. As a function of the predetermined operating conditions of such a motor/pump unit, it is also possible with this solution to ensure the required homogeneous temperature level in the flywheel 12. The wall 29, which is remote from the pump and is formed by the pump-side motor cover 25, of the flywheel chamber 24 is in this case subjected to the high-pressure motor cooling system E with the aid of a connection 39. A shaft seal 38 is arranged in the region of the wall 25 and reduces mixing of the fluids.

Figure 5:
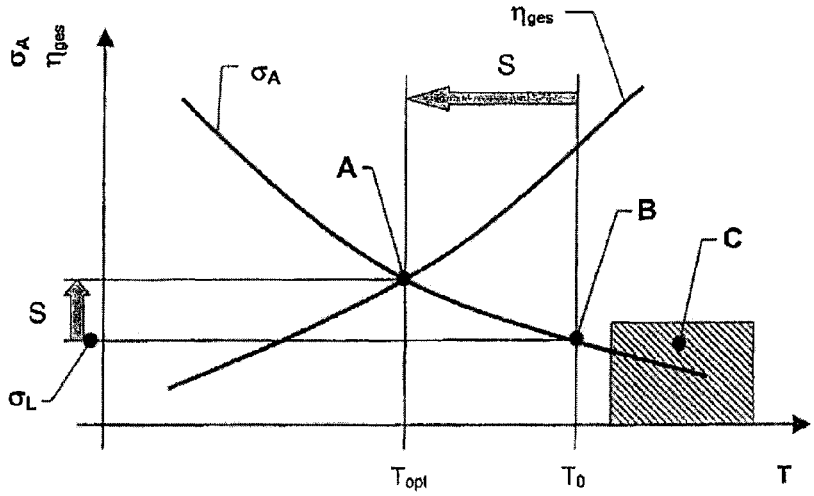
FIG. 5 is a graph of the temperature distribution on the flywheel.

The graph in FIG. 5 shows a first curve line $\sigma_A$, which shows a decisive strength property of the material of the flywheel body as a function of the temperature. This strength property, for example 80% of the apparent yield point, includes a sufficient safety reserve with respect to material failure.

In a second curve line $\eta_{tot}$, the total efficiency of the motor/pump unit is plotted against the temperature. The temperature corresponds to that which can prevail in the flywheel chamber. The point of intersection A of the two curve lines corresponds to the operating point of the motor/pump unit in all functioning cooling systems. At this point A, the optimum operating temperature $T_{opt}$ prevails. In this case, a homogeneous temperature level $T_{opt}$ is set in the flywheel chamber and in the flywheel.

This operating point A also has a further high safety margin S with respect to those operating states in which a failure of an external cooling system was expected. If such a state takes place, in which one or more external cooling systems fail, which is to be referred to as a fault case, owing to the internal fluid friction within the flywheel chamber, the temperature will increase until it reaches a maximum temperature $T_0$ which can be set.

Such a temperature rise results in the viscosity of the conveyed fluid being reduced as a result of the rising temperature and thus the power loss in the flywheel chamber decreasing. As a result, the total efficiency $\eta_{tot}$ of the motor/pump unit increases. The negative effect of a temperature rise is, however, a decrease in the material strength of the flywheel body to a lower value $\sigma_L$ at the temperature $T_0$. In the event of a failure of an external cooling system, a fault-case operating point B thus results in the flywheel chamber at a higher temperature level $T_0$. At this operating point B, however, the strength of the flywheel body is still ensured owing to the 20% apparent yield point reserve remaining in this example. The area C illustrated using hashed lines in the graph on the right-hand side next to the fault-case operating point B indicates an impermissible operating range.

As a result of an improvement in the total efficiency $\eta_{tot}$ being dispensed with intentionally, a significant improvement in the operational reliability is thus achieved. Even in the case of a failure of an external cooling device, reliable operation of the motor/pump unit is still assured. Even in this case there is no danger of the flywheel failing as a result of impermissible stress states in the material of the flywheel body. As a result, it is possible to omit complex protective devices for the flywheel, which leads to a major reduction in costs and an increase in the operational reliability of such a motor/pump unit.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A motor/pump assembly comprising a fluid-filled, hermetically sealed pressure enclosure containing an electric motor, a coolant pump coaxial with said motor comprising at least one impeller arranged in an impeller enclosure defined within a pump housing, a shaft assembly for transmitting a torque from the motor to the at least one impeller, a flywheel on said shaft assembly, said flywheel disposed within a flywheel chamber formed between a pump cover and a motor cover and arranged between the electric motor and the impeller enclosure, a motor mount disposed nearer to the flywheel than to the pump, within said motor cover, and so as to surround the shaft assembly, and a pump bearing disposed between the impeller enclosure and the flywheel chamber, wherein said flywheel comprises a flywheel body having a plurality of radially and circumferentially distributed, axially oriented cavities of various sizes with inserts of various sizes corresponding to the sizes of said cavities received therein, the inserts comprising a heavy-metal having a density of greater than 11.0 kg/dm$^3$arranged fixed in the flywheel body in said cavities to promote continued flywheel body rotation by increasing a flywheel body moment of inertia, wherein a flow path passing through the pump housing interconnects said impeller enclosure, downstream of said impeller, and said flywheel chamber within which said flywheel is disposed, and wherein the motor cover has a connection for fluid communication with a cooling system of the motor, fluid communicating with the cooling system of the motor also acting as lubricating fluid for said motor mount.

2. A motor/pump assembly according to claim 1, wherein said flywheel body is made of high-strength steel.

3. A motor/pump assembly according to claim 1, further comprising means for screening the heavy-metal inserts from the fluid which fills the pressure enclosure.

4. A motor/pump assembly according to claim 1, wherein the heavy-metal inserts are in the form of cartridges.

5. A motor/pump assembly according to claim 1, wherein the heavy-metal inserts are in the form of beds of bulk material secured in the cavities.

6. A motor/pump assembly according to claim 1, wherein the shaft assembly does not pass through a hole in the flywheel body.

7. A motor/pump assembly according to claim 1, wherein the flywheel body is connected to the shaft assembly by flange connections.

8. A motor/pump assembly according to claim 7, wherein the flywheel body is connected to the shaft assembly by one-piece flange connections.

9. A motor/pump assembly according to claim 7, wherein the flywheel body is connected to the shaft assembly by multi-part flange connections.

10. A motor/pump assembly according to claim 1, wherein the flywheel body is connected to the shaft assembly by end toothed sections.

11. A motor/pump assembly according to claim 1, wherein:

at least one cylindrical heat exchanger which surrounds the outer diameter of the flywheel is arranged within the flywheel chamber and forms a radial wall face within said flywheel chamber;

said flow path is a first fluid flow path passing through the pump housing that is connected by at least one flow path passing over the outside of the heat exchanger to a side of the flywheel chamber remote from the pump; and a first return-flow path between the side of the flywheel chamber remote from the pump and a side of the flywheel chamber adjacent the pump is formed by an annular gap between the heat exchanger and the flywheel.

12. A motor/pump assembly according to claim 11, wherein at least two cylindrical heat exchangers coaxially surround the flywheel, and an annular gap or a plurality of channels between the heat exchangers form the first return-flow path.

13. A motor/pump assembly according to claim 11, wherein a second fluid flow path arranged in a region of the shaft assembly connects to the side of the flywheel chamber adjacent the impeller enclosure to provide for fluid return to the impeller and lubrication of said pump bearing, and wherein at least one conveying device driven by the shaft assembly is arranged in a second return-flow path.

14. A motor/pump assembly according to claim 11, wherein the at least one cylindrical heat exchanger is connected to an external cooling water source.

15. A motor/pump assembly according to claim 1, wherein the motor cover is a pump-side motor cover that forms a wall of the flywheel chamber remote from the pump, and the motor cooling system is at least partly arranged in the motor cover.

16. A motor/pump assembly according to claim 15, wherein the motor cooling system is a low-pressure cooling system.

17. A motor/pump assembly according to claim 15, wherein the motor cooling system is a high-pressure cooling system.

18. A motor/pump assembly according to claim 1, wherein the motor is arranged in a motor chamber, and a shaft seal is arranged in the region of the shaft assembly between the motor chamber and the flywheel.

19. A motor/pump assembly comprising:

a fluid-filled, hermetically sealed pressure enclosure containing an electric motor, a coolant pump coaxial with said motor comprising at least one impeller arranged in an impeller enclosure defined within a pump housing, a shaft assembly for transmitting a torque from the motor to the at least one impeller, a flywheel on said shaft assembly, said flywheel disposed within a flywheel chamber formed between a pump cover and a motor cover and arranged between the electric motor and the impeller enclosure, a motor mount disposed nearer to the flywheel than to the pump, within said motor cover, and so as to surround the shaft assembly, and a pump bearing disposed between the impeller enclosure and the flywheel chamber, wherein said flywheel comprises a flywheel body having a plurality of radially and circumferentially distributed, axially oriented cavities of various sizes with inserts of various sizes corresponding to the sizes of said cavities received therein, the inserts comprising a heavy-metal having a density of greater than 11.0kg/dm$^3$arranged fixed in the flywheel body in said cavities to promote continued flywheel body rotation by increasing a flywheel body moment of inertia, wherein a first fluid flow path passing through the pump housing interconnects said impeller enclosure, downstream of said impeller, and said flywheel chamber within which said flywheel is disposed, wherein the shaft assembly does not pass through a hole in the flywheel body, wherein the flywheel body is connected to the shaft assembly by end toothed sections, and wherein:

at least one cylindrical heat exchanger which surrounds the outer diameter of the flywheel is arranged within the flywheel chamber and forms a radial wall face within said flywheel chamber, said first fluid flow path passing through the pump housing is connected by at least one flow path passing over the outside of the heat exchanger to a side of the flywheel chamber remote from the pump, a first return-flow path between the side of the flywheel chamber remote from the pump and a side of the flywheel chamber adjacent the pump is formed by an annular gap between the heat exchanger and the flywheel, a second return-flow path arranged in the region of the shaft assembly connects the side of the flywheel chamber adjacent the pump to the impeller enclosure to provide for fluid return to the impeller enclosure and lubrication of said pump bearing, and the motor cover has a connection for fluid for a motor cooling system, the fluid for the motor cooling system also acting as lubricating fluid for said motor mount.

20. A motor/pump assembly comprising a fluid-filled, hermetically sealed pressure enclosure containing an electric motor, a coolant pump coaxial with said motor comprising at least one impeller arranged in an impeller enclosure defined within the pump housing, a shaft assembly for transmitting a torque from the motor to the at least one impeller, a flywheel on said shaft assembly, said flywheel disposed within a flywheel chamber formed between a pump cover and a motor cover and arranged between the electric motor and the impeller enclosure, a motor mount disposed nearer to the flywheel than to the pump, within said motor cover, and so as to surround the shaft assembly, and a pump bearing disposed between the impeller enclosure and the flywheel chamber, wherein said flywheel comprises a flywheel body having a plurality of radially and circumferentially distributed, axially oriented cavities of various sizes with inserts of various sizes corresponding to the sizes of said cavities received therein, the inserts comprising a heavy-metal having a density of greater than 11.0kg/dm$^3$arranged fixed in the flywheel body in said cavities to promote continued flywheel body rotation by increasing a flywheel body moment of inertia, wherein a first fluid flow path passing through the pump housing interconnects said impeller enclosure, downstream of said impeller, and said flywheel chamber within which said flywheel is disposed, wherein a second fluid flow path arranged in a region of the shaft assembly connects to a side of the flywheel chamber adjacent the impeller enclosure to provide for fluid return to the impeller and lubrication of said pump bearing, and wherein the motor cover has a connection for fluid for a motor cooling system, the fluid for the motor cooling system also acting as lubricating fluid for said motor mount.

* * * * *